United States Patent [19]

Buth et al.

[11] 4,334,648

[45] Jun. 15, 1982

[54] AIRFLOW LIMITER AND MEASUREMENT DEVICE

[75] Inventors: Randy L. Buth, Rogers; Robert A. Essig, Plymouth, both of Minn.

[73] Assignee: McQuay-Perfex Inc., Minneapolis, Minn.

[21] Appl. No.: 200,960

[22] Filed: Oct. 27, 1980

[51] Int. Cl.[3] ..... F24F 7/06

[52] U.S. Cl. ..... 236/49; 137/486; 251/78

[58] Field of Search ..... 236/49, 80 D; 251/78, 251/77; 137/486, 499

[56] References Cited

U.S. PATENT DOCUMENTS

| | | | |
|---|---|---|---|
| 3,809,314 | 5/1974 | Engelke et al. | 236/49 |
| 3,840,177 | 10/1974 | Osheroff | 236/49 |
| 3,945,565 | 3/1976 | Lynch et al. | 236/49 |
| 4,017,025 | 4/1977 | Dravniaks et al. | 236/49 |
| 4,108,371 | 8/1978 | Leemhuis | 236/49 |
| 4,224,959 | 9/1980 | Fling | 251/78 X |
| 4,258,877 | 3/1981 | White | 236/49 |

*Primary Examiner*—William E. Tapolcai, Jr.

*Attorney, Agent, or Firm*—Merchant, Gould, Smith, Edell, Welter & Schmidt

[57] ABSTRACT

An air conditioning system including an air flow limiter and indicator comprising, in combination: a chamber (24) extending from an inlet (21) to an outlet (22) for flow therebetween of conditioned air at greater than ambient pressure; a damper (63) in the chamber actuable to variably restrict the flow; apparatus outside the chamber, including an inflatable member (66) having inlet (70) and venting (42) openings, for actuating the damper in accordance with the state of inflation of the member; condition-responsive apparatus, including a fluid amplifier (72) supplying fluid from the chamber to the inlet opening, for causing inflation and deflation of the inflatable member; apparatus including a vane (32) in the conduit for responding to the rate of flow of the fluid in the conduit; apparatus (41, 57) normally closing the venting opening; and apparatus (43, 45, 55) operable by the vane as the rate of flow exceeds a predetermined value for unclosing the venting opening, to enable deflation of the inflatable means independent of the condition-responsive apparatus.

6 Claims, 9 Drawing Figures

FIG. 8
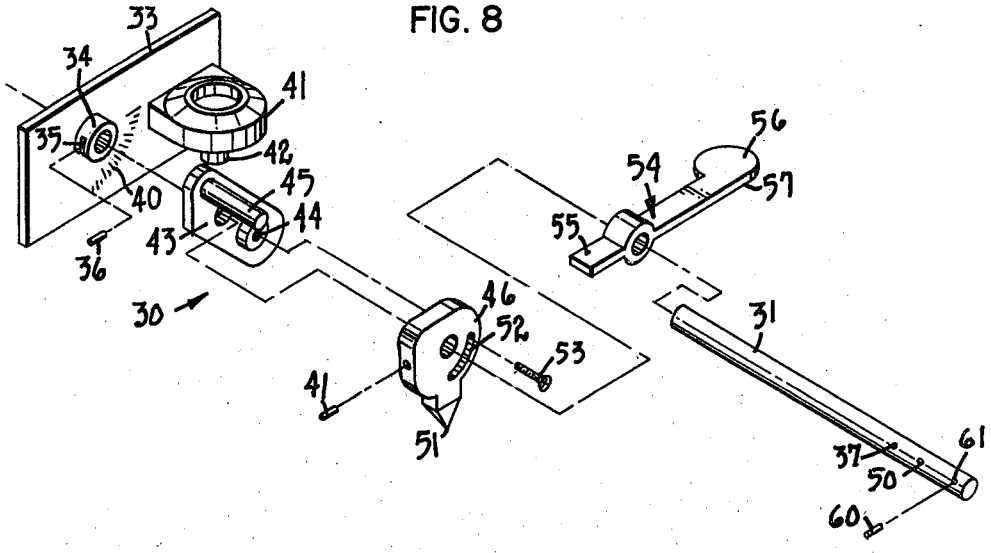
FIG. 1
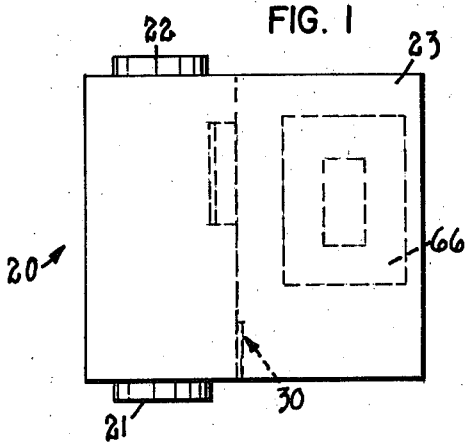
FIG. 3
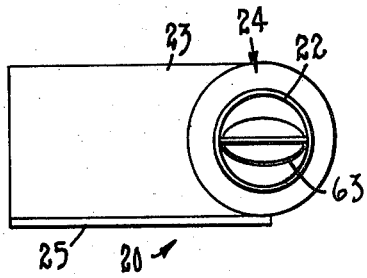
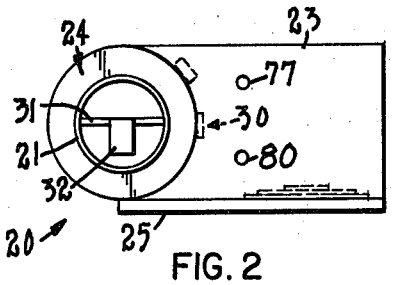
FIG. 2
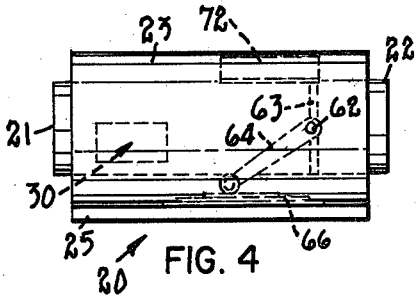
FIG. 4

FIG. 5
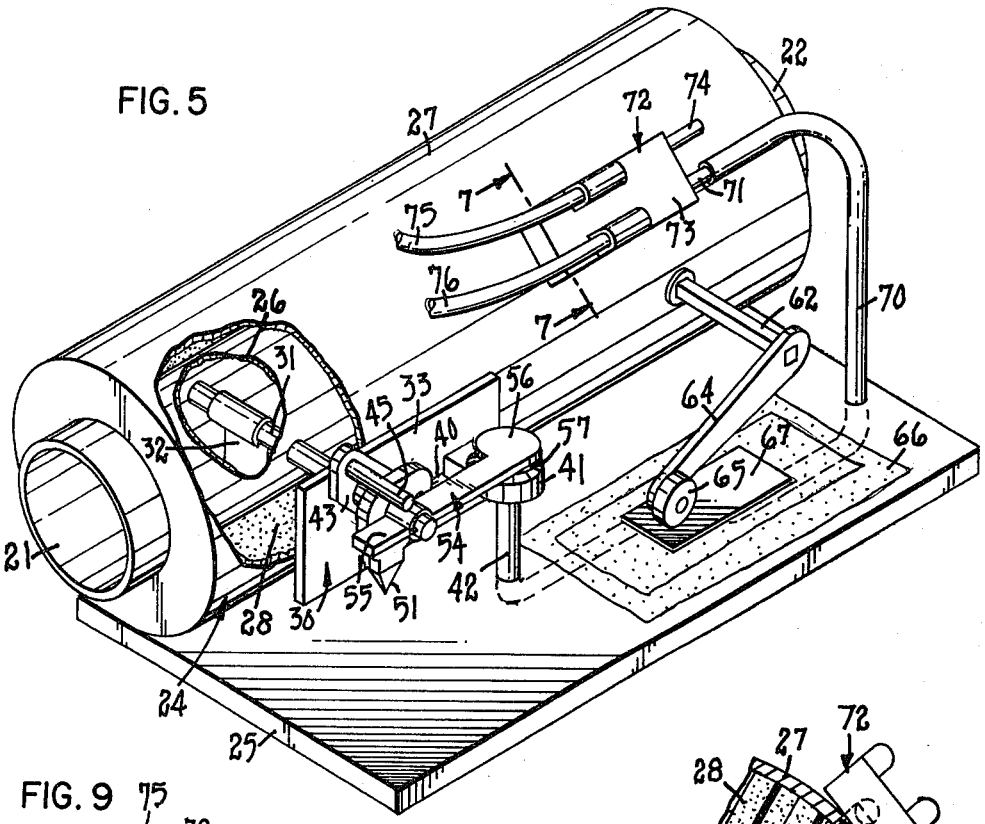
FIG. 9
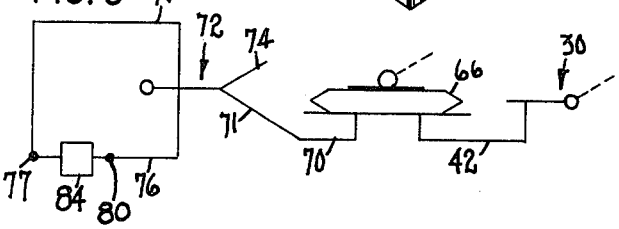
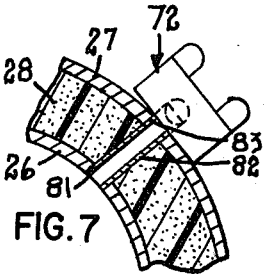
FIG. 7
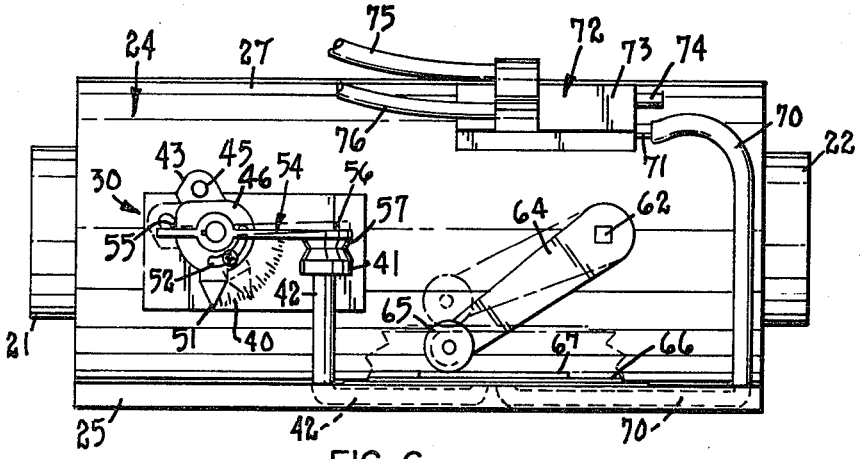
FIG. 6

AIRFLOW LIMITER AND MEASUREMENT DEVICE

TECHNICAL FIELD

This invention relates to the field of heating, ventilating and air conditioning, and particularly to air flow control systems in which fluidic principles are employed to provided controlled air flow of heating or cooling air to maintain the temperature of a space within a desired range.

BACKGROUND OF THE INVENTION

In installations for air conditioning large buildings from a single thermal source it is customary to divide the total space into a number of zones, each provided with a thermostat and means actuated thereby for regulating the rate of flow of conditioned air from the source to the room so that it is heated or cooled to the desire temperature. Successful temperature control in a zone by this system assumes that the pressure at which conditioned air is supplied remains uniform, but uniform pressure is not easy to obtain in systems having numerous zones independently increasing or decreasing their loads on the source. To take care of this it has been proposed to provide flow responsive means, in addition to the usual temperature responsive means, for limiting the rate of air flow to each of the several zones. At least one such system has been devised in which the entire control operation is actuated fluidically, the control medium being air taken from the source itself. Such a system is shown in Osheroff U.S. Pat. No. 3,840,177, in which the flow of air from a source to a zone is varied by a bellows under the control of a fluidic device actuated in turn by a thermostat in the zone. In that system the rate of flow is limited by apparatus including a pressure probe which regulates the escape of air from the bellows.

BRIEF SUMMARY OF THE INVENTION

The present invention comprises an improvement on that of U.S. Pat. No. 3,840,177 in two major respects. In the first place, a simple mechanical linkage including an unbalanced vane is provided to replace the more esoteric and less reliable pressure probe for sensing deviations in the input air pressure from the source. In the second place, the bellows has been removed from a location in which it was outwardly subject to the pressure within the duct, and placed where it is subject only to the ambient pressure, thus removing one of the complicating factors in accomplishing satisfactory temperature control.

The invention thus constitutes an air conditioning system fluidically controlled to vary the rate of conditioned air supply not only in accordance with the temperature in a zone to be controlled, but also in accordance with the rate of flow itself, when the later exceeds a predetermined value. The fluidic system is energized with air from the source itself, to control a butterfly valve in accordance with zone temperature by admitting air to or releasing air from a bellows subject externally only to ambient air pressure, and is overridden by operation of an unbalanced vane whenever the air flow enabled by the butterfly valve exceeds a predetermined level.

Various advantages and features of novelty which characterize the invention are pointed out with particularity in the claims annexed hereto and forming a part hereof. However, for a better understanding of the invention, its advantages, and objects attained by its use, reference should be had to the drawing which forms a further part hereof, and to the accompanying descriptive matter, in which there is illustrated and described a preferred embodiment of the invention.

BRIEF DESCRIPTION OF THE DRAWING

In the drawing, in which like reference numerals indicate corresponding parts throughout the several views, FIG. 1 is a plan view of apparatus embodying the invention;

FIGS. 2 and 3 are opposite end views and

FIG. 4 is a side view of the apparatus of FIG. 1;

FIG. 5 is a view in perspective of the apparatus with a housing removed, to a larger scale;

FIG. 6 is a side view of the apparatus of FIG. 4, to a slightly smaller scale;

FIG. 7 is a fragmentary sectional view along the line 7—7 of FIG. 5;

FIG. 8 is an exploded view of a portion of the apparatus of FIG. 5; and

FIG. 9 shows schematically a system including the invention.

DESCRIPTION OF THE PREFERRED EMBODIMENT

An air flow limiter 20 according to the invention is shown in FIGS. 1–6 to have an inlet 21 and an outlet 22, and to be contained in a removable housing 23. A chamber 24 mounted on a base 25 extends between inlet 21 and outlet 22 and preferably comprises inner and outer conduits 26 and 27 confining a cylinder 28 of heat-insulating material.

An air flow responsive assembly 30 is shown in FIGS. 5, 6, and 8 to comprise a shaft 31 passing diametrically through chamber 24 near inlet 21 and carrying an unbalanced vane 32 within the chamber. A mounting plate 33 carried on the outside of chamber 24 includes a bearing 34 for shaft 31: an arcuate slot 35 in the bearing provides passage for a pin 36 which projects into a hole 37 in shaft 31, to limit the motion of the shaft both axially and in rotation. A scale of angular graduations 40 central about the axis of shaft 31 is carried on plate 33, as is a valve seat 41 of small diameter to which is connected a flexible conduit 42.

An arm 43 is freely rotatable on shaft 31, and carries a tapped boss 44 and a cog or pin 45 extending away from plate 33 parallel to the axis of shaft 31. A pointer 46 is secured to shaft 31 by a pin 47 projecting into a hole 50 in shaft 31. Pointer 46 has an index 51 for cooperating with graduations 40, and also has an arcuate slot 52 coaxial with shaft 51 through which a clamping screw 53 passes to threadedly engage boss 44 and secure members 43 and 44 together and to shaft 31, member 43 being angularly adjustable with respect to member 46, which is not adjustable on the shaft.

A paddle or valve arm 54 is freely rotatable on shaft 31, and has a short actuation portion 55, extending from shaft 31 in one direction, and a long valving portion 56, extending in the other direction and carrying a gasket or pad 57 on its under surface. A pin 60 projecting from a hole 61 at the end of shaft 51 retains arm 54 on the shaft while enabling relative rotation therebetween.

A second shaft 62 extends diametrically across chamber 24 near outlet 22, and carries a generally circular vane 63 to act as a butterfly valve for varying the flow of air through the chamber. An actuating arm 64 projects radially from the shaft 62 outside of chamber 24 and carries a roller 65. The weight of arm 64 and roller 65 are sufficient to rotate shaft 62 into a normal position in which vane 63 offers greatest opposition to air flow through chamber 24.

A long life bellows 66 is mounted on base 25, topped by a pressure plate 67 to protect the surface of the bellows from abrasion by contact with roller 65, which bears downwardly against plate 67. Conduit 42 opens into bellows 67, as does a further flexible conduit 70 leading from one outlet port 71 of a fluidic device 72 mounted on the outside of chamber 24. Device 72 has a body 73, a second output port 74, and a pair of control ports coupled by flexible conduits 75 and 76 to connections 77 and 80 of housing 23. Power fluid for device 72 is supplied from within chamber 24 through aligned holes 81, 82, and 83 in inner conduit 26, insulation 28, and outer conduit 27 respectively.

In use the apparatus is connected in the ducting which supplies conditioned air to a space or zone of which the temperature is to be controlled, the source being connected to inlet 21 and the space to outlet 22. As shown in FIG. 9, a pneumatic thermostat 84 in the space is connected by suitable tubing to connections 77 and 80. Pointer 46 is positioned on shaft 31 so that index 51 is at an initial graduation on scale 40 when vane 32 hangs downward, and screw 53 is tightened at an intermediate position in slot 52 which causes cog 45 to engage actuation portion 55 when vane 32 is in an off-vertical position resulting from a desired maximum rate of air flow into chamber 24.

OPERATION

When the temperature in the space to be controlled is within a desired limit, a minimum flow of ventilating air moves through chamber 24 past butterfly valve 63. This flow is sufficient to pivot vane 32 and rotate shaft 31 slightly, but not enough to bring cog 45 into engagement with actuation portion 55, so that pad 57 closes against seat 41, and conduit 42 is closed. The pressure in chamber 24 is above ambient, and air flows through holes 81, 82, 83 into device 72. With the temperature within limits thermostat 84 is not calling for temperature change, through conduits 75 and 76, so the air is discharged from device 72 at port 74. No air passes to bellows 66, and the pressure at port 71 may even be slightly sub-ambient, so that the bellows remains completely collapsed.

If the temperature goes outside the desired limit, thermostat 84 acts through conduits 75 and 76 to switch the flow of air in device 72 so that it discharges into port 71 and therefore through conduit 70 into bellows 66, expanding the bellows and so acting through roller 65 to pivot arm 64, and butterfly valve 63 begins to allow the flow of more conditioned air to the space. The air admitted to bellows 66 by device 72 cannot escape through conduit 42 because the unbalanced weight of valve arm 54 retains pad 57 against seat 41.

The greater flow of air permitted by opening of valve 63 also affects vane 32, causing movement of the index with respect to scale 40 to give a visual indication of the amount of air flow.

When the greater flow of conditioned air returns the temperature in the space to the desired value, opposite action of thermostat 84 and device 72 takes place, and bellows 66 deflates to enable closure of butterfly vane 63.

If, by reason of simultaneous closure of several other loads on the source of conditioned air for example, the flow of air through chamber 24 for a given position of vane 63 becomes too great, the air acts on vane 32 to rotate shaft 31 until cog 45 engages actuation portion 55 of valve arm 54, unseating pad 57 from seat 41 and allowing escape of air from bellows 66 through conduit 42. This in turn allows partial collapse of bellows 66 and hence partial closing of the butterfly valve, so that the actual discharge of conditioned air into the space is reduced to that appropriate for the heating or cooling function being performed.

From the above it will be evident that the invention includes an improved air flow limiter having means fluidically controlling the temperature in a space by admitting and releasing the air in an expansible member which is externally subject only to the ambient pressure, and further including means actuated by excessive air flow to release air from the expansible member independently of the fluidic control means.

Numerous characteristics and advantages of the invention have been set forth in the foregoing description, together with details of the structure and function of the invention, and the novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms in which the appended claims are expressed.

What is claimed is:

1. An air flow control system for an air conditioning system comprising, in combination:

a chamber extending from an inlet to an outlet for flow therebetween of conditioned air;

an unbalanced vane pivotally mounted in said chamber for angular movement from an initial position in accordance with the rate of said flow;

means outside said chamber operatively connected for movement in response to the angular movement of said vane for indicating the rate of flow of air in said chamber;

a flapper valve including a seat and a flapper arm pivotally movable into and out of sealing engagement with said seat to close and open said valve;

a lost motion connection between said vane and said flapper arm for pivoting said flapper arm out of said sealing engagement when said rate of flow exceeds a predetermined magnitude; and control means responsive to said flapper valve for limiting air flow when said rate of flow exceeds a predetermined magnitude.

2. An air flow control system according to claim 1, wherein said control means includes;

an inflatable member;

first means connected to said inflatable member for normally causing inflation and deflation of said member;

and means connecting said flapper valve to said inflatable member to independently enable deflation thereof when said flapper arm is out of engagement with said seat.

3. An air flow control system according to claim 1 in which said vane includes a pivot shaft extending out of said chamber, and said flapper arm is mounted on said shaft for normally free rotary movement of said shaft with respect thereto, and in which said lost motion member includes a radial flange extending axially along said arm, a further member rotatable on said shaft and having a cog extending axially for engagement by said flange upon relative rotation between said member and said arm, and means adjustably fixing the rotated position of said further member on said shaft.

4. An air flow control system according to claim 1 wherein said control means includes a damper for varying the rate of flow through said chamber, fluidic means normally operating said damper in response to a condition, and means overriding the operation of said fluidic means when said flapper valve is open.

5. An air flow control system for an air conditioning system for maintaining the temperature of a space comprising, in combination:

a chamber extending from an inlet to an outlet for flow of conditioned air at superambient pressure from said inlet through said outlet to said space;

a damper in said chamber actuable to vary the rate of said flow between maximum and minimum values, said damper including a shaft extending outside said chamber and carrying an actuating lever;

means outside said chamber, including an inflatable member having inlet and venting openings, for engaging said actuating lever to actuate said damper in accordance with the state of inflation of said inflatable member;

fluidic means for supplying air from said chamber to said inlet opening, to inflate said inflatable member, and for enabling deflation of said inflatable member;

condition responsive means connected in controlling relation to said fluidic means;

an unbalanced vane pivotally mounted in said chamber for angular movement from an initial position in accordance with the rate of said flow, including a shaft extending outside said chamber;

a flapper valve comprising a seat connected to said venting opening and a flapper arm pivotally movable into and out of sealing engagement with said seat to close and open said valve;

means mounting said flapper arm for normally free rotary movement of said shaft of said vane with respect thereto;

a radial flange extending axially of said shaft along said flapper arm;

a lost motion member rotatable on said shaft and having a cog extending axially for engagement with said flange upon relative rotation between said member and said arm;

and means adjustably fixing the rotative position of said lost motion member to said shaft such that said cog comes into engagement with said flange at a predetermined point in the movement of said vane from said initial position.

6. A system according to claim 5 in which said vane is upstream from said damper.

* * * * *